United States Patent [19]

Dewey

[11] 3,945,233

[45] Mar. 23, 1976

[54] SHEET METAL STRIP ROLLER APPARATUS

[76] Inventor: Herbert F. Dewey, 1368 Mac Drive, Stow, Ohio 44224

[22] Filed: Mar. 27, 1975

[21] Appl. No.: 562,853

[52] U.S. Cl. ..... 72/181

[51] Int. Cl.[2] ..... B21D 5/08

[58] Field of Search ..... 72/181, 178, 177, 161

[56] References Cited

UNITED STATES PATENTS

| | | | |
|---|---|---|---|
| 2,352,675 | 7/1944 | Yoder | 72/181 |
| 2,471,490 | 5/1949 | Mercer | 72/178 |
| 2,505,241 | 4/1950 | Gray et al. | 72/181 |
| 3,791,185 | 2/1974 | Knudson | 72/181 |

*Primary Examiner*—Milton S. Mehr

*Attorney, Agent, or Firm*—Oldham & Oldham Co.

[57] ABSTRACT

A lightweight inexpensive metal rolling apparatus for sheet metal including a lightweight elongate frame, a series of forming rolls secured to shaft's journaled in metal roller wheels secured to the frame and depending therefrom, and a second series of metal-forming rolls operatively positioned in association with the first by metal bars adjustably engaging said metal wheels and dependant therefrom and having shafts fixedly connected thereto and extending therebetween. Inlet guide means are provided for the metal strip and an outlet adjustable roller guide is provided to aid in forming an accurate, straight end product.

6 Claims, 12 Drawing Figures

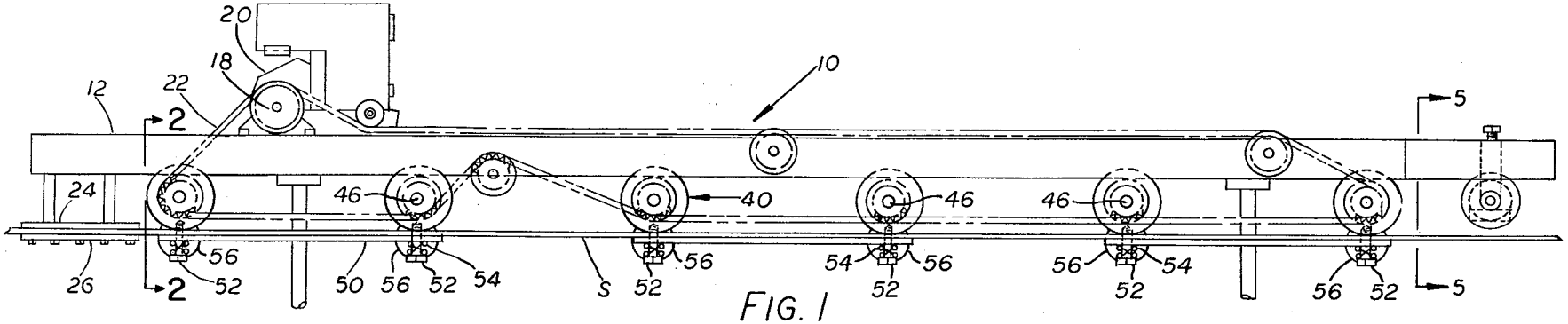
FIG. 1
FIG. 2
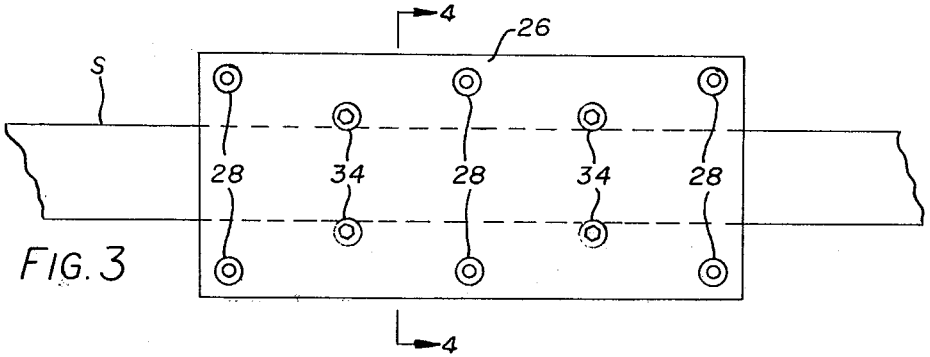
FIG. 3
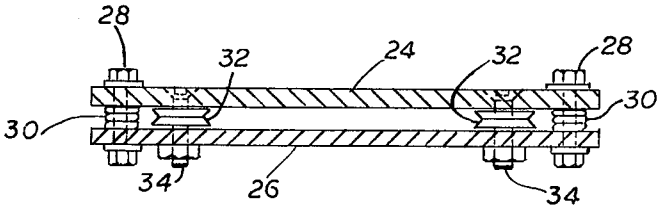
FIG. 4

SHEET METAL STRIP ROLLER APPARATUS

BACKGROUND OF THE INVENTION

Heretofore, there have been many different kinds of strip metal roll-forming apparatus provided, but most of such apparatus has been quite massive and costly. When forming sheet metal members, it obviously is desirable to have lighter weight, lower cost roll-forming apparatus than would be required in shaping heavier gauges of metal.

One prior metal strip roll-forming apparatus is shown in my previous U.S. Letters Pat. No. 3,785,191. Many other shapes of metal also must be provided than that shown in my prior Patent, and it naturally is desirable to use as inexpensive but sturdy members as possible in forming strip metal to the desired contours.

The general object of the present invention is to provide a lightweight, inexpensive, but efficiently functional roll apparatus for contouring metal strips to desired shapes.

Another object of the invention is to use commercially available members such as metal wheel units in positioning roll-carrying shafts in the apparatus.

Another object of the invention is to provide inexpensive but sturdy adjustable means for positioning second forming rolls of a pair of forming rolls in operative association with first rolls that are non-adjustably positioned in the apparatus.

Other objects of the invention are to provide simplified, lightweight inlet guide means for the metal strip to feed it into the apparatus properly; to provide guide and straightening members adjacent the output of the roll stand to contour the end product as accurately as possible to the desired cross sectional shape and to aid in axially straightening the end product; to provide roll-forming apparatus for metal strips wherein the apparatus will form, for example, either end products of substantially U-shape or L-shape in section; and to provide roll forming means in apparatus of the type described wherein one edge roll in the female forming rolls of the roll stand are separate units removably positioned in the roll-forming apparatus to open one side edge of each roll-forming pair and permit variation in the cross sectional shape of the end product.

The foregoing and other objects and advantages of the present invention will be made more apparent as the Specification proceeds.

Reference now is particularly directed to the accompanying drawings wherein:

FIG. 1 is a somewhat diagrammatic side elevation of apparatus embodying the principles of the invention;

FIG. 2 is a fragementary vertical section taken on line 2-2 of FIG. 1;

FIG. 3 is a fragmentary plan of an inlet guide means provided for apparatus of the invention and shown to reduced scale;

FIG. 4 is a fragmentary vertical section taken on line 4—4 of FIG. 3;

When referring to corresponding members shown in the drawings and referred to in the specification, corresponding numerals are used to facilitate comparison therebetween.

Figure 5:
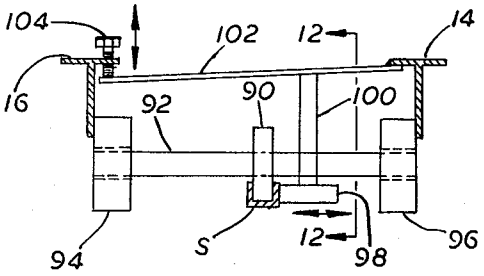
FIG. 5 is a fragmentary section taken on line 5—5 of FIG. 1.
Figure 6:
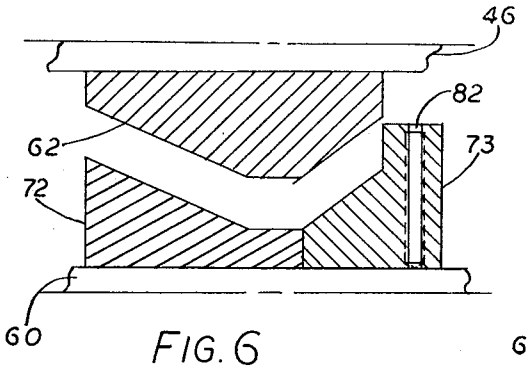
FIGS. 6 through 10 are fragmentary sections through the pairs of roll-forming means of the invention for progressively shaping the metal strip to desired contour.
Figure 7:
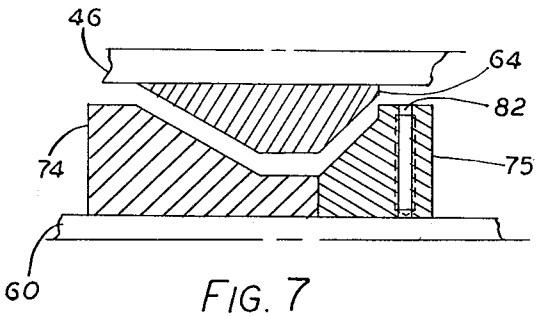
Figure 8:
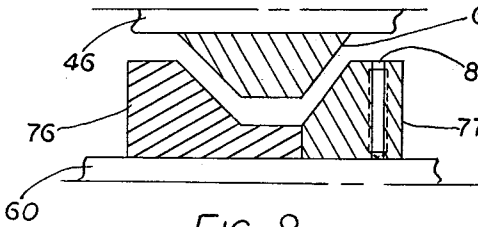
Figure 9:
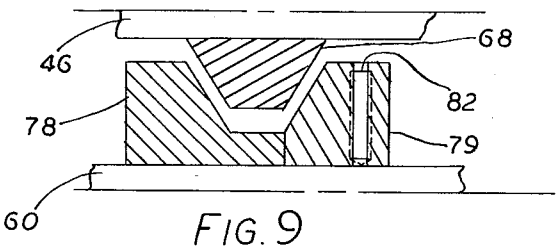
Figure 12:
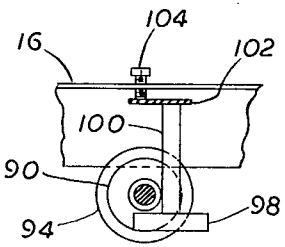
FIG. 12 is a section on line 12—12 of FIG. 5.
Figure 10:
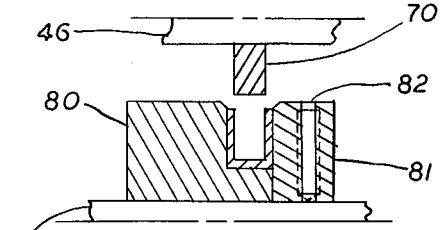
Figure 11:
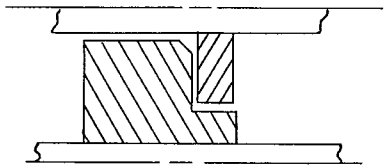
FIG. 11 is a view of the roll of FIG. 10 with one edge forming roll thereon removed.

The pairs of rolls shown in FIGS. 6 through 10 are separated from each other and are not in closely spaced relation as would be required when the pairs of rolls are operatively positioned. These rolls may be of any desired contour but preferably they form an end product of angular shape in section.

SUBJECT MATTER OF THE INVENTION

The invention, as one embodiment thereof relates to strip metal rolling apparatus including a frame having opposed side members, several pairs of rotatable wheel members fixedly secured to opposed longitudinally shaped portions of the side rails and depending therefrom, a shaft carrying an upper forming roll thereon journalled in and extending between each of the pairs of wheel members, a plurality of roll-mounting bars each secured to and extending between pairs of adjacent wheel members, which metal bars are secured to each of the pairs of wheel members for vertical adjusting movement therebetween, a positioning shaft carrying a lower forming roll fixedly secured to and extending between opposed sections of a pair of laterally opposed bars to provide two roll-carrying shafts on each of these bars in spaced longitudinal relation, and the upper and lower forming rolls on said shafts being operatively associated in pairs in the apparatus for progressively forming a metal strip fed into and through the rolling apparatus. The invention includes rolls formed in two parts whereby an edge forming roll section can be removed to vary the shape of the roll formed product. Special straightening means are provided adjacent the discharge end of the apparatus to engage the rolled metal strip, and inlet guide means are present in the apparatus.

Regarding the details of the apparatus shown in the drawings, the strip metal rolling apparatus is indicated as a whole by the numeral 10 and it includes a frame 12. The frame 12 has a pair of opposed side members 14 and 16 extending the substantial length thereof and a plurality of pairs of metal forming rolls are operatively positioned on this apparatus with the pairs of rolls being in longitudinally spaced relationship to each other so that a strip of metal S fed into the apparatus will be progressively shaped to substantially U-Shape or other angular form in section by the apparatus of the invention.

The apparatus of the invention is driven in any conventional manner as by an electric motor 18 that connects by suitable speed reducer or the like 20 to a drive chain 22 which extends along one side of the apparatus for engaging and driving one roll positioning shaft of each of the plurality of pairs of forming rolls provided in the apparatus.

Specifically, the metal strip S is fed into the apparatus between a pair of vertically spaced or sandwiched plates 24 and 26 that are secured together as by bolts 28 and wherein the bolt shanks position a plurality of washers 30 in the portions of the bolt shank positioned between the plates to space the same a desired distance.

A plurality of edge guides or rolls 32 are provided on each lateral margin of an open center portion of the plates 24 and 26 so that these rolls 32, that are carried on vertically extending bolts 34 or the like, are rotatably positioned in and suitably spaced in the inlet means for engaging opposed lateral margins of the metal strip fed into the apparatus.

The individual forming rolls in the apparatus are preferably positioned by means of substantially conventional, commercially available components. That is, the side members 14 and 16 in the frame preferably are T-shaped angles and a plurality of metal wheel members 40 are secured to the dependant flanges of these side members 14 and extend therebelow. Each metal wheel 40 includes an annular outer section (or wheel) 42 that suitably journals a rotatably positioned center tubular section or ring 44 therein. The metal section or ring 42 is secured as by welding to one of the side members to depend therefrom and suitable support shaft 46 is positioned in and extends between the inner rings 42 of a pair of the metal wheels 40. Such wheels 40 include a bearing case usually used to support the sections 42 but which now journal the center rings 44 on the fixed outer rings. These metal wheels 40 are secured to laterally opposed portions of the side members in longitudinally spaced relation whereby each pair of metal wheels has a roll support shaft journalled therein and extending transversely of the frame between the opposed side members. One end of each of these shafts 46 protrudes laterally beyond the frame a short distance and carries a sprocket 48 thereon for engaging the drive chain 22 for driving one roll of each of the pairs of forming rolls provided in the apparatus.

FIGS. 1 and 2 of the drawings best show that the second roll of each of the pairs of forming rolls in the apparatus is positioned by means such as individual support bars 50 secured to lower portions of the metal wheels 40 as herein described. These support bars 50 are positioned in the apparatus so that one such bar is secured to and extends between pairs of adjacent metal wheels on the same side of the apparatus and with only one of such support bars being secured to each of the metal wheels. Specifically, cap screws 52 are provided at each end of each support bar and extend therethrough for threaded engagement with tapped sockets provided in lower parts of the rings 42 of the wheel members 40. Coil springs 54 are carried by the shanks of each of the cap screws 52 to urge the support bar into resilient engagement with a peripheral portion of the associated wheel members but with the vertical position of the support bar being controllable, for example, by a threaded engagement of the cap screw shank with a tapped aperture in the support bar to move it toward and from the adjacent wheel member. Shims or washers 55 are placed between the bars 50 and the wheels 40 to aid in varying the position of the roll support shaft. The coil springs 54 urge the support bars vertically upwardly at all times whereby small adjustment in the positions of the support bars can be provided. These support bars 50 each position an upstream roll positioning metal ring 56 and a downstream metal ring 58 thereon with the metal wheels or rings 56 and 58 being, for example, welded to laterally inner edges of the support bars and with the metal sleeves or rings extending downwardly therefrom to position a roll support shaft 60 in and extending between each of the pairs of opposed metal rings provided in the apparatus.

FIGS. 6 through 10 show a plurality of the associated support shafts 46 and 60 that position the pairs of forming rolls in operative association with each other. These drawings further show male forming rolls 62, 64, 66, 68 and 70 positioned on the individual driven support shafts 46 in the apparatus whereas the associated female forming rolls 72, 74, 76, 78 and 80 are carried on the individual support shafts 60 that are positioned in longitudinally spaced parallel relationship in the apparatus and with these various female forming rolls being suitably journalled on the support shafts provided therefor, or with the shafts being journalled in a pair of opposed rings 56 or 58.

As another feature of the invention, each of the female forming rolls as shown comprises or has been formed in two parts, each of annular form. Thus, an edge forming roll 73, 75, 77, 79 and 81 is provided as a portion of each of the female forming rolls and individual set screws 82 engage with each of these edge forming rolls and they bear against the support shafts 60 to lock the edge forming rolls in position, but yet to permit removal of such edge forming rolls when desired. That is, normally the forming rolls as shown are adapted to provide an end member having a vertical flange, a horizontal flange and a second vertical flange therein, but yet when it is not desired to form the substantially U-shaped member, the edge forming rolls can be removed and then a substantially L-shaped end product is formed.

So as to aid in guiding and straightening the end product of the roll stand, FIG. 5 shows a straightening means or assembly used in the apparatus. Thus, an end roll 90 is positioned in a vertical plane and carried on a shaft 92 journalled in two of the metal wheel units 94 and 96 so that the roll 90 can engage the shaped metal part S preparatory to discharge of the same. A straightening roll 98 which is horizontally positioned and has a vertical axis is carried on a vertically positioned shaft 100 and is suitably journalled thereon. Such shaft or rod 100 in turn is carried on a cantilevered positioned cross bar 102, one end of which is secured to the side member 14 as shown and with the cross bar extending over and termining adjacent the second side member 16. In order to adjust the position of the horizontal forming or guide roll 98, a set screw 104 or the like engages the side member 16 and bears on the free end of the cross bar. Thus, adjustment of the set screw 104 will change the bend or positioning of the cross bar 102 and likewise adjust the position of the guide and straightening roll 98 which is used to urge the vertically extending flange of the shaped metal part S against the roll 90 and straighten or finalize the shape thereof to provide the desirable end product.

This apparatus of the invention is relatively low in cost and light in weight. The apparatus will function effectively for rapidly shaping light gauge metal to desired contours and the rolls provided will permit variation in the contour of the shaped metal to at least the two different contours as described herein. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. In a strip metal rolling apparatus, a frame means including opposed side members, several pairs of metal wheel members fixedly secured to opposed portions of said side members and depending therefrom, a shaft carrying an upper forming roll thereon journalled in and extending between each of said pairs of metal wheel members, a plurality of roll mounting bars, each secured to and extending between pairs of adjacent metal wheel members positioned on the same one of said side members, means securing each of said bars to said pairs of said wheel members for vertical adjusting movement, a positioning shaft carrying a lower forming roll thereon fixedly secured to and extending between opposed forward sections of a pair of laterally opposed bars and a second lower roll carrying shaft similarly secured to and extending between rearward portions of said bars, said upper and lower forming rolls being operatively associated in operative paris in the apparatus.

2. In strip metal rolling apparatus as in claim 1, a metal inlet guide means on said frame and comprising a pair of sandwiched plates, having an axially open center area, spaced apart to receive the metal strip therein, and opposed side roller means positioned between said plates to engage side edges of said metal strip and center it in the apparatus.

3. In strip metal rolling apparatus as in claim 1 for forming an angular in section end member, a vertical cylindrical end guide roll journalled on a support and positioned to engage the angular end member, a horizontally positioned guide roll, a cantilevered cross bar carried by one of said frame side members and extending to the other of said side members, a vertically extending shaft having said last named guide roll journalled thereon depending from said cross bar and operatively engaging said end member adjacent said first named guide roll to aid in the final shaping of said end member as it moves along the apparatus.

4. In strip metal rolling apparatus as in claim 1, where male and female rolls are present for engaging and progressively shaping a metal strip passing therethrough, said rolls being adapted to form a metal strip to U-shape in section adn characterized by each of said female rolls being made of two parts, one being an edge roll and the second being a combined base and edge roll to enable removal of said edge rolls to produce a section of generally L-shape.

5. In strip metal rolling apparatus for forming an end member having a vertical and a horizontal flange therein, a frame having opposed side members, an end guide roll journalled on a support and positioned to engage the flanges of the end member, said guide roll defining a vertical plane, a horizontally positioned guide roll having a vertical axis, a cantilevered cross bar secured at one end to one of said side members and extending at its other end to the other of said side members, and a vertically extending shaft having said last named guide roll journalled thereon depending from said cross bar and operatively engaging the vertical flange of said end member adjacent said first named guide roll to aid in straightening said end member as it moves along the apparatus.

6. In apparatus as in claim 5 and including an adjustment member engaging said other side member and extending therefrom to engage the other end of said cross bar, and vary its position to control the position of said horizontally positioned guide roll.

* * * * *